US010113540B2

(12) United States Patent
Barito et al.

(10) Patent No.: US 10,113,540 B2
(45) Date of Patent: Oct. 30, 2018

(54) LINEAR COMPRESSOR

(71) Applicant: General Electric Company, Schenectady, NY (US)

(72) Inventors: Thomas Robert Barito, Louisville, KY (US); Gregory William Hahn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 468 days.

(21) Appl. No.: 14/873,465

(22) Filed: Oct. 2, 2015

(65) Prior Publication Data

US 2017/0096991 A1 Apr. 6, 2017

(51) Int. Cl.

| | |
|---|---|
| ***F04B 53/14*** | (2006.01) |
| ***F04B 53/16*** | (2006.01) |
| ***F04B 53/18*** | (2006.01) |
| ***F04B 35/04*** | (2006.01) |
| ***F04B 39/00*** | (2006.01) |
| ***F04B 37/00*** | (2006.01) |

(52) U.S. Cl.

CPC ..... *F04B 35/04* (2013.01); *F04B 35/045* (2013.01); *F04B 37/00* (2013.01); *F04B 39/0005* (2013.01); *F04B 39/0027* (2013.01); *F04B 39/0061* (2013.01); *F04B 53/14* (2013.01); *F04B 53/16* (2013.01); *F04B 53/18* (2013.01)

(58) Field of Classification Search

CPC .... F04B 35/04; F04B 35/045; F04B 39/0027; F04B 39/0005; F04B 39/0061; F04B 53/16; F04B 53/18; F04B 37/00; F04B 53/14

USPC ..... 310/15, 17, 25, 13, 14

See application file for complete search history.

(56) References Cited

U.S. PATENT DOCUMENTS

| | | | | |
|---|---|---|---|---|
| 4,040,445 | A * | 8/1977 | McCormick | F15B 13/0402 137/596.18 |
| 4,793,775 | A * | 12/1988 | Peruzzi | F04B 39/0055 417/312 |
| 5,645,407 | A * | 7/1997 | Kralick | F04B 45/047 310/17 |
| 6,398,523 | B1 | 6/2002 | Hur et al. | |
| 2015/0226202 | A1* | 8/2015 | Beers | F04B 9/02 417/363 |

FOREIGN PATENT DOCUMENTS

| | | | |
|---|---|---|---|
| DE | 2013013252 | A1 * | 2/2015 |
| DE | 102013013252 | A1 | 2/2015 |
| KR | 20070075900 | A * | 7/2007 |

OTHER PUBLICATIONS

English Abstract for KR20070075900A dated Jul. 2007.*

* cited by examiner

*Primary Examiner* — Nathan Zollinger
(74) *Attorney, Agent, or Firm* — Dority & Manning, P.A.

(57) ABSTRACT

A linear compressor includes an inner back iron positioned in a driving coil. A flex mount is positioned within the inner back iron and is coupled to the inner back iron. A coupling extends between the flex mount and a piston, and a compliant bellows is coupled to the flex mount and the piston.

20 Claims, 4 Drawing Sheets

LINEAR COMPRESSOR

FIELD OF THE INVENTION

The present subject matter relates generally to linear compressors, e.g., for refrigerator appliances.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant.

Utilizing linear compressors to generate compressed refrigerant can have challenges. For example, certain linear compressor draw heated vapor refrigerant within a shell of the linear compressor into the chamber where the heated vapor refrigerant mixes with other refrigerant prior to compression and negatively affect performance of the linear compressor. Such linear compressors can also recirculate lubricating oil into the flow of refrigerant entering the chamber. As another example, friction between the piston and a wall of the chamber can negatively affect operation of the linear compressors if the piston is not suitably aligned within the chamber. In particular, friction losses due to rubbing of the piston against the wall of the chamber can negatively affect the efficiency of an associated refrigerator appliance.

Accordingly, a linear compressor with features for regulating fluid flow into a chamber of the linear compressor would be useful. In addition, a linear compressor with features for limiting friction between a piston and a wall of a cylinder during operation of the linear compressor would be useful.

BRIEF DESCRIPTION OF THE INVENTION

The present subject matter provides a linear compressor. The linear compressor includes an inner back iron positioned in a driving coil. A flex mount is positioned within the inner back iron and is coupled to the inner back iron. A coupling extends between the flex mount and a piston, and a compliant bellows is also coupled to the flex mount and the piston. Additional aspects and advantages of the invention will be set forth in part in the following description, or may be apparent from the description, or may be learned through practice of the invention.

In a first exemplary embodiment, a linear compressor is provided. The linear compressor includes a cylinder that defines a chamber. A piston is slidably received within the chamber of the cylinder. The linear compressor also includes a driving coil. An inner back iron is positioned in the driving coil. The inner back iron has an outer surface. A magnet is mounted to the inner back iron at the outer surface of the inner back iron such that the magnet faces the driving coil. A flex mount is positioned within the inner back iron and is coupled to the inner back iron. A coupling extends between the flex mount and the piston. A compliant bellows is coupled to the flex mount and the piston.

In a second exemplary embodiment, a linear compressor is provided. The linear compressor includes a cylinder that defines a chamber. A piston is slidably received within the chamber of the cylinder. The linear compressor also includes a driving coil. An inner back iron is positioned in the driving coil. The inner back iron has an outer surface. A magnet is mounted to the inner back iron at the outer surface of the inner back iron. The driving coil is operable to generate a magnetic field that engages the magnet to reciprocate the inner back iron within the driving coil. A flex mount is positioned within the inner back iron and coupled to the inner back iron. A coupling connects the flex mount to the piston such that the piston reciprocates with the inner back iron. A compliant bellows extends about the coupling between the inner back iron and the piston. The compliant bellows includes an elastomer tube with concertinaed sides.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
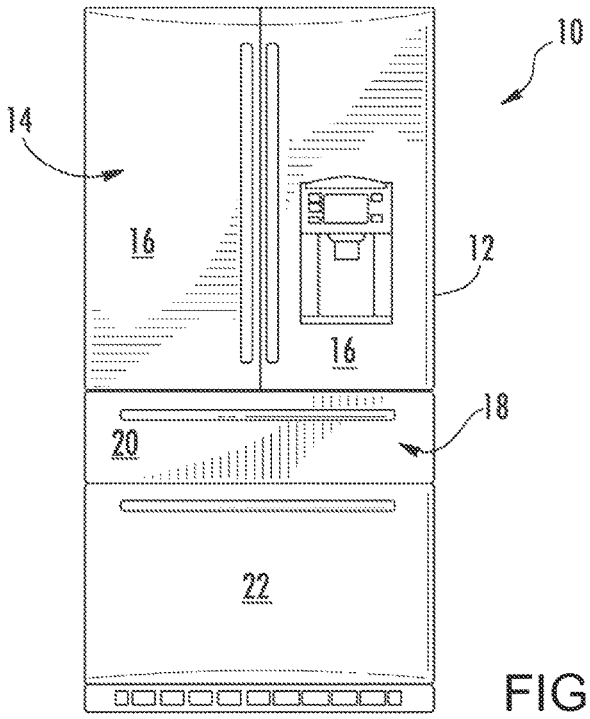
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
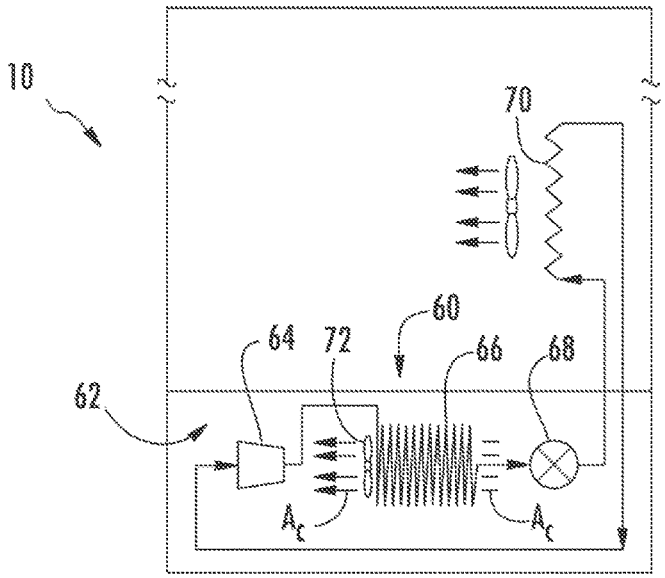
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
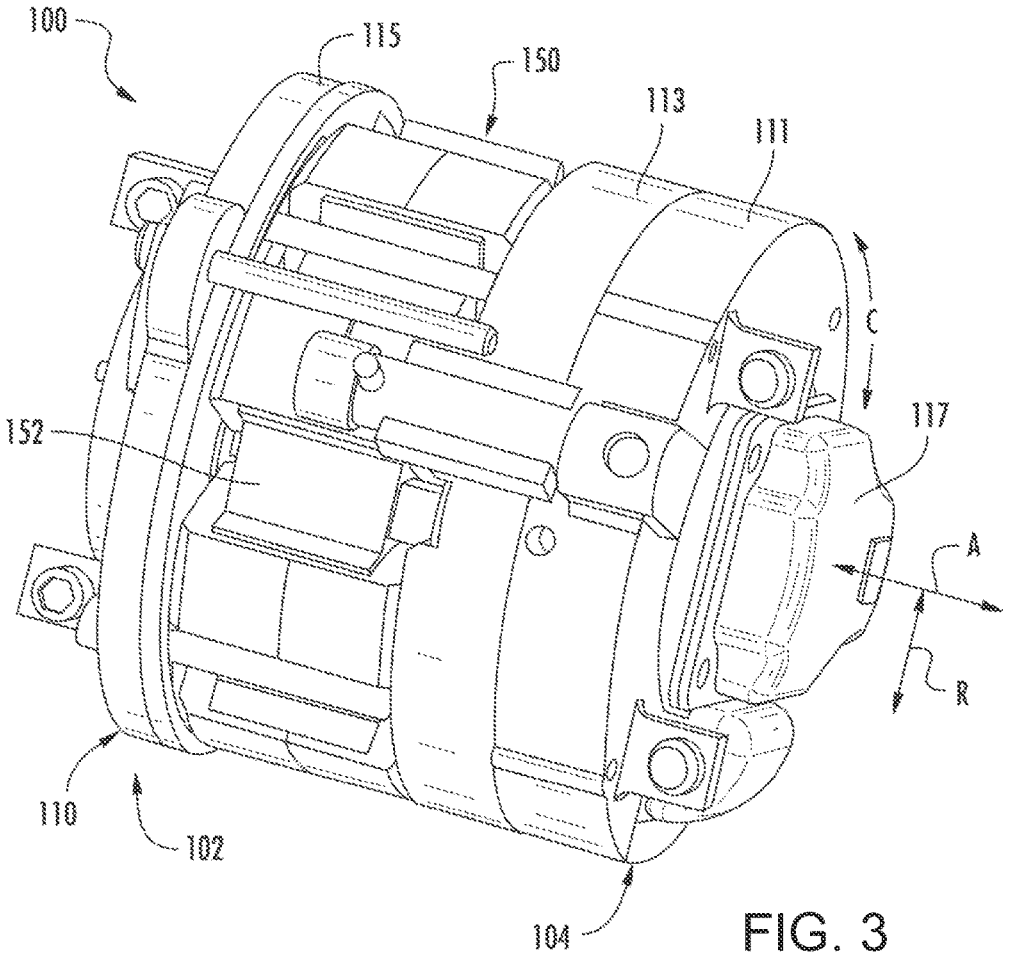
FIG. 3 provides a perspective view of a linear compressor according to an exemplary embodiment of the present subject matter.
Figure 4:
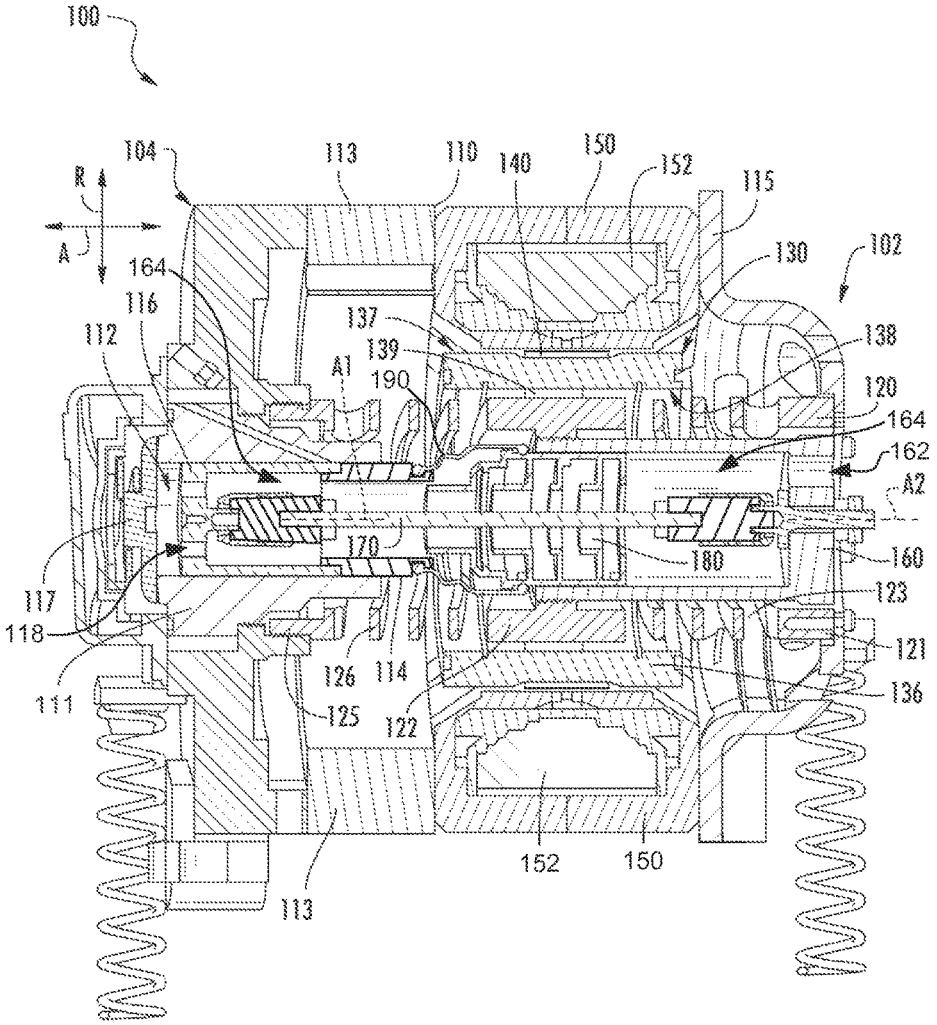
FIG. 4 provides a section view of the exemplary linear compressor of FIG. 3.

FIG. 3 provides a perspective view of a linear compressor 100 according to an exemplary embodiment of the present subject matter. FIG. 4 provides a section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 4, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

As may be seen in FIG. 4, linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C. Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap. Thus, the air gap may be defined between opposing surfaces of driving magnet 140 and driving coil 152. Driving magnet 140 may also be mounted or fixed to inner back iron assembly 130 such that an outer surface of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap between outer back iron 150 and inner back iron assembly 130 during operation of linear compressor 100, and linear compressor 100 may be more efficient relative to linear compressors with air gaps on both sides of a driving magnet.

As may be seen in FIG. 4, driving coil 152 extends about inner back iron assembly 130, e.g., along the circumferential direction C. Driving coil 152 is operable to move the inner back iron assembly 130 along a second axis A2 during operation of driving coil 152. The second axis may be substantially parallel to the axial direction A and/or the first axis A1. As an example, driving coil 152 may receive a current from a current source (not shown) in order to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 along the second axis A2 and piston head 116 along the first axis A1 during operation of driving coil 152. Thus, driving coil 152 may slide piston assembly 114 between the top dead center position and the bottom dead center position, e.g., by moving inner back iron assembly 130 along the second axis A2, during operation of driving coil 152.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by supplying current to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 also includes a spring 120. Spring 120 is positioned in inner back iron assembly 130. In particular, inner back iron assembly 130 may extend about spring 120, e.g., along the circumferential direction C. Spring 120 also extends between first and second end portions 102 and 104 of casing 110, e.g., along the axial direction A. Spring 120 assists with coupling inner back iron assembly 130 to casing 110, e.g., cylinder assembly 111 of casing 110. In particular, inner back iron assembly 130 is fixed to spring 120 at a middle portion of spring 120 as discussed in greater detail below.

During operation of driving coil 152, spring 120 supports inner back iron assembly 130. In particular, inner back iron assembly 130 is suspended by spring 120 within the stator or the motor of linear compressor 100 such that motion of inner back iron assembly 130 along the radial direction R is hindered or limited while motion along the second axis A2 is relatively unimpeded. Thus, spring 120 may be substantially stiffer along the radial direction R than along the axial direction A. In such a manner, spring 120 can assist with maintaining a uniformity of the air gap between driving magnet 140 and driving coil 152, e.g., along the radial direction R, during operation of the motor and movement of inner back iron assembly 130 on the second axis A2. Spring 120 can also assist with hindering side pull forces of the motor from transmitting to piston assembly 114 and being reacted in cylinder assembly 111 as a friction loss.

Spring 120 may include a first cylindrical portion 121, a second cylindrical portion 122, a first helical portion 123, a third cylindrical portion 125 and a second helical portion 126. First helical portion 123 of spring 120 extends between and couples first and second cylindrical portions 121 and 122 of spring 120, e.g., along the axial direction A. Similarly, second helical portion 126 of spring 120 extends between and couples second and third cylindrical portions 122 and 125 of spring 120, e.g., along the axial direction A.

First cylindrical portion 121 is mounted or fixed to casing 110 at first end portion 102 of casing 110. Thus, first cylindrical portion 121 is positioned at or adjacent first end portion 102 of casing 110. Third cylindrical portion 125 is mounted or fixed to casing 110 at second end portion 104 of casing 110, e.g., to cylinder assembly 111 of casing 110. Thus, third cylindrical portion 125 is positioned at or adjacent second end portion 104 of casing 110. Second cylindrical portion 122 is positioned at a middle portion of spring 120. In particular, second cylindrical portion 122 is positioned within and fixed to inner back iron assembly 130. Second cylindrical portion 122 may also be positioned equidistant from first and third cylindrical portions 121 and 125, e.g., along the axial direction A.

First cylindrical portion 121 of spring 120 is mounted to casing 110 with fasteners that extend through end cap 115 of casing 110 into first cylindrical portion 121. In alternative exemplary embodiments, first cylindrical portion 121 of spring 120 may be threaded, welded, glued, fastened, or connected via any other suitable mechanism or method to casing 110. Third cylindrical portion 125 of spring 120 is mounted to cylinder assembly 111 at second end portion 104 of casing 110 via a screw thread of third cylindrical portion 125 threaded into cylinder assembly 111. In alternative exemplary embodiments, third cylindrical portion 125 of spring 120 may be welded, glued, fastened, or connected via any other suitable mechanism or method, such as an interference fit, to casing 110.

First helical portion 123 extends, e.g., along the axial direction A, between first and second cylindrical portions 121 and 122 and couples first and second cylindrical portions 121 and 122 together. Similarly, second helical portion 126 extends, e.g., along the axial direction A, between second and third cylindrical portions 122 and 125 and couples second and third cylindrical portions 122 and 125 together. Thus, second cylindrical portion 122 is suspended between first and third cylindrical portions 121 and 125 with first and second helical portions 123 and 126. First, second and third cylindrical portions 121, 122 and 125 and first and second helical portions 123 and 126 of spring 120 may be positioned coaxially relative to one another, e.g., on the second axis A2.

First and second helical portions 123 and 126 and first, second and third cylindrical portions 121, 122 and 125 of spring 120 may be continuous with one another and/or integrally mounted to one another. As an example, spring 120 may be formed from a single, continuous piece of metal, such as steel, or other elastic material. As another example, first and second helical portions 123 and 126 and first, second and third cylindrical portions 121, 122 and 125 of spring 120 may be separate components that are mounted or fastened together to form spring 120.

First helical portion 123 includes a first pair of helices. Thus, first helical portion 123 may be a double start helical spring. In particular, first helical portion 123 may be formed into a double-helix structure in which each helical coil is wound in the same direction and connect first and second cylindrical portions 121 and 122 of spring 120. Similarly, second helical portion 126 also includes a pair of helices. Thus, second helical portion 126 may be a double start helical spring. In particular, second helical portion 126 may be formed into a double-helix structure in which each helical coil is wound in the same direction and connect second and third cylindrical portions 122 and 125 of spring 120.

By providing first and second helical portions 123 and 126, a force applied by spring 120 may be more even and/or inner back iron assembly 130 may rotate less during motion of inner back iron assembly 130 along the second axis A2. In addition, the helices of first and second helical portions 123 and 126 may be counter or oppositely wound. Such opposite winding may assist with further balancing the force applied by spring 120 and/or inner back iron assembly 130 may rotate less during motion of inner back iron assembly 130 along the second axis A2.

Inner back iron assembly 130 includes an outer cylinder 136 and a sleeve 139. Outer cylinder 136 defines outer surface 137 of inner back iron assembly 130 and also has an inner surface 138 positioned opposite outer surface 137 of outer cylinder 136. Sleeve 139 is positioned on or at inner surface 138 of outer cylinder 136. A first interference fit between outer cylinder 136 and sleeve 139 may couple or secure outer cylinder 136 and sleeve 139 together. In alternative exemplary embodiments, sleeve 139 may be welded, glued, fastened, or connected via any other suitable mechanism or method to outer cylinder 136.

Sleeve 139 extends about spring 120, e.g., along the circumferential direction C. In addition, a middle portion of spring 120 (e.g., second cylindrical portion 122) is mounted or fixed to inner back iron assembly 130 with sleeve 139. Sleeve 139 extends between inner surface 138 of outer cylinder 136 and the middle portion of spring 120, e.g., along the radial direction R. In particular, sleeve 139 extends between inner surface 138 of outer cylinder 136 and second cylindrical portion 122 of spring 120, e.g., along the radial direction R. A second interference fit between sleeve 139 and the middle portion of spring 120 may couple or secure sleeve 139 and the middle portion of spring 120 together. In alternative exemplary embodiments, sleeve 139 may be welded, glued, fastened, or connected via any other suitable mechanism or method to the middle portion of spring 120 (e.g., second cylindrical portion 122 of spring 120).

Outer cylinder 136 may be constructed of or with any suitable material. For example, outer cylinder 136 may be constructed of or with a plurality of (e.g., ferromagnetic) laminations. The laminations are distributed along the circumferential direction C in order to form outer cylinder 136 and are mounted to one another or secured together, e.g., with rings pressed onto ends of the laminations. Outer cylinder 136 defines a recess that extends inwardly from outer surface 137 of outer cylinder 136, e.g., along the radial direction R. Driving magnet 140 is positioned in the recess on outer cylinder 136, e.g., such that driving magnet 140 is inset within outer cylinder 136.

A piston flex mount 160 is mounted to and extends through inner back iron assembly 130. In particular, piston flex mount 160 is mounted to inner back iron assembly 130 via sleeve 139 and spring 120. Thus, piston flex mount 160 may be coupled (e.g., threaded) to spring 120 at second cylindrical portion 122 of spring 120 in order to mount or fix piston flex mount 160 to inner back iron assembly 130. A coupling 170 extends between piston flex mount 160 and piston assembly 114, e.g., along the axial direction A. Thus, coupling 170 connects inner back iron assembly 130 and piston assembly 114 such that motion of inner back iron assembly 130, e.g., along the axial direction A or the second axis A2, is transferred to piston assembly 114. Coupling 170 may extend through driving coil 152, e.g., along the axial direction A.

Coupling 170 may be a compliant coupling that is compliant or flexible along the radial direction R. In particular, coupling 170 may be sufficiently compliant along the radial direction R such that little or no motion of inner back iron assembly 130 along the radial direction R is transferred to piston assembly 114 by coupling 170. In such a manner, side pull forces of the motor are decoupled from piston assembly 114 and/or cylinder assembly 111 and friction between piston assembly 114 and cylinder assembly 111 may be reduced.

Piston flex mount 160 defines at least one suction gas inlet 162. Suction gas inlet 162 of piston flex mount 160 extends, e.g., along the axial direction A, through piston flex mount 160. Thus, a flow of fluid, such as air or refrigerant, may pass through piston flex mount 160 via suction gas inlet 162 of piston flex mount 160 during operation of linear compressor 100.

Piston head 116 also defines at least one opening 118. Opening 118 of piston head 116 extends, e.g., along the axial direction A, through piston head 116. Thus, the flow of fluid may pass through piston head 116 via opening 118 of piston head 116 into chamber 112 during operation of linear compressor 100. In such a manner, the flow of fluid (that is compressed by piston head 116 within chamber 112) may flow through piston flex mount 160 and inner back iron assembly 130 to piston assembly 114 during operation of linear compressor 100.

Linear compressor 100 also includes features for isolating the flow of the flow of fluid from piston flex mount 160 to piston assembly 114 during operation of linear compressor 100. As may be seen in FIG. 4, linear compressor 100 includes a compliant bellows 190. Compliant bellows 190 is coupled to piston flex mount 160 and piston assembly 114. Thus, compliant bellows 190 may reciprocate with piston flex mount 160 and piston assembly 114, e.g., along the axial direction A, during operation of linear compressor 100. Compliant bellows 190 may extend about coupling 170, e.g., along the circumferential direction C, between inner back iron assembly 130 and piston assembly 114. In addition, compliant bellows 190 may be positioned within second helical portion 126 of spring 120 between inner back iron assembly 130 and piston assembly 114.

Piston flex mount 160, compliant bellows 190 and piston assembly 114 may be arranged, e.g., along the axial direction A, such that piston flex mount 160, compliant bellows 190 and piston assembly 114 collectively define a suction gas passage 164. Suction gas passage 164 extends from suction gas inlet 162 of piston flex mount 160 to opening 118 of piston head 116, e.g., along the axial direction A within piston flex mount 160, compliant bellows 190 and piston assembly 114. Thus, a flow of fluid may enter suction gas passage 164 at suction gas inlet 162 of piston flex mount 160 and flow through suction gas passage 164, e.g., along the axial direction A, to opening 118 of piston head 116 during operation of linear compressor 100.

Compliant bellows 190 may be positioned for limiting lubricating oil and/or heated vapor refrigerant within the hermetic shell of linear compressor 100 from flowing into suction gas passage 164 between inner back iron assembly 130 and piston assembly 114. In particular, lubricating oil may be provided at an interface between piston assembly 114 and cylinder assembly 111, e.g., to reduce friction between piston assembly 114 and cylinder assembly 111, during operation of linear compressor 100. Compliant bellows 190 may obstruct or block the lubricating oil from flowing into suction gas passage 164 and thereby negatively affecting efficiency or performance of linear compressor 100. As another example, heated vapor refrigerant may be disposed within the hermetic shell of linear compressor 100 about casing 110 or within casing 110, and compliant bellows 190 may obstruct or block the heated vapor refrigerant from flowing into suction gas passage 164 and thereby negatively affecting efficiency or performance of linear compressor 100.

As may be seen in FIG. 4, a muffler 180 may be disposed within suction gas passage 164. Muffler 180 may assist with regulating the flow of fluid through suction gas passage 164, e.g., to reduce the operating noise of linear compressor 100. Muffler 180 may be mounted to piston flex mount 160 within inner back iron assembly 130. One end of compliant bellows 190 may be positioned on and mounted to muffler 180 within inner back iron assembly 130, and an opposite end of compliant bellows 190 may be positioned on and mounted to piston assembly 114.

Figure 5:
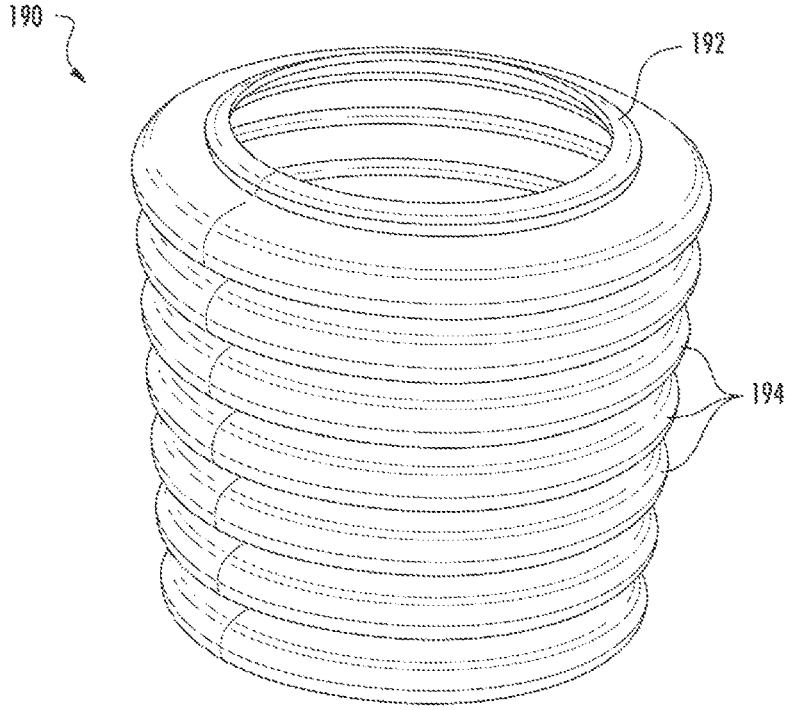
FIG. 5 provides a perspective view of a compliant bellows of the exemplary linear compressor of FIG. 3.

FIG. 5 provides a perspective view of compliant bellows 190. As may be seen in FIG. 5, compliant bellows 190 may include a tube 192 with concertinaed sides 194. Tube 192 may be constructed of or with any suitable material. For example, tube 192 may be constructed of an elastically deformable material, such as an elastomer or aluminum. Concertinaed sides 194 may permit elastic deformation of tube 192, e.g., such that compliant bellows 190 weakly couples inner back iron assembly 130 to piston assembly 114. Thus, compliant bellows 190 may be compliant or flexible along the radial direction R, e.g., radially compliant. In particular, coupling 170 may be sufficiently compliant along the radial direction R such little or no motion of inner back iron assembly 130 along the radial direction R is transferred to piston assembly 114 by compliant bellows 190. In such a manner, side pull forces of the motor are decoupled from piston assembly 114 and/or cylinder assembly 111 and friction between piston assembly 114 and cylinder assembly 111 may be reduced. Compliant bellows 190 may include any suitable number of folds at concertinaed sides 194. For example, compliant bellows 190 may include at least three folds at concertinaed sides 194.

Figure 6:
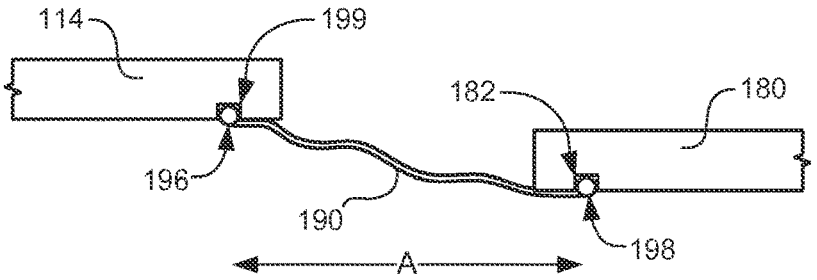
FIG. 6 provides a partial, section view of the compliant bellows of the exemplary linear compressor of FIG. 3.

FIG. 6 provides a partial, section view of compliant bellows 190. As may be seen in FIG. 6, compliant bellows 190 may extend between a first end portion 196 and a second end portion 198, e.g., along the axial direction A. First end portion 196 of compliant bellows 190 may be positioned at and coupled to piston assembly 114, and second end portion 198 of compliant bellows 190 may be positioned at and coupled to muffler 180 (or piston flex mount 160 in alternative exemplary embodiments). As shown in FIG. 6, compliant bellows 190 defines a bead at each of the first and second end portions 196, 198 of compliant bellows 190. The bead at first end portion 196 of compliant bellows is received within a slot 199 defined by piston assembly 114 in order to couple or mount compliant bellows 190 to piston assembly 114 at first end portion 196 of compliant bellows 190. Similarly, the bead at second end portion 198 of compliant bellows is received within a slot 182 defined by muffler 180 in order to couple or mount compliant bellows 190 to muffler 180 at second end portion 198 of compliant bellows 190. Thus, interference between the beads at first and second end portions 196, 198 of and piston assembly 114 and muffler 180, respectively, assist with mounting compliant bellows 190 within linear compressor 100. It should be understood that any other suitable method or mechanism may be used to mount compliant bellows 190 within linear compressor 100 in alternative exemplary embodiments. For example, adhesive, fasteners, welds, etc. may be used to mounted bellows 190 within linear compressor 100 in alternative exemplary embodiments.

While described above in the context of linear compressor 100, it should be understood that bellows 190 may be used in or with any suitable linear compressor in alternative exemplary embodiments. For example, bellows 190 may be used in or with the linear compressor described in U.S. Patent Publication No. 2015/0226197A1 of Gregory William Hahn et al., filed on Feb. 10, 2014, which is hereby incorporated by reference in its entirety for all purposes. In particular, bellows 190 may extend between and/or be mounted to the piston assembly and the inner back iron assembly described in U.S. Patent Publication No. 2015/0226197A1, where the inner back iron is coupled to a planar spring. In such a manner, bellows 190 may be positioned for limiting lubricating oil and/or heated vapor refrigerant from leaking into a refrigerant flow path between the inner back iron assembly and the piston assembly. Thus, bellows 190 may be used in linear compressors with planar springs in certain exemplary embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor, comprising:

a cylinder defining a chamber;

a piston slidably received within the chamber of the cylinder;

a driving coil;

an inner back iron positioned in the driving coil, the inner back iron having an outer surface;

a magnet mounted to the inner back iron at the outer surface of the inner back iron such that the magnet faces the driving coil;

a flex mount positioned within the inner back iron and coupled to the inner back iron;

a coupling extending between the flex mount and the piston;

a compliant bellows coupled to the flex mount and the piston; and a muffler mounted to the flex mount within the inner back iron, one end of the compliant bellows mounted to the muffler within the inner back iron.

2. The linear compressor of claim 1, further comprising a helical spring, the helical spring coupling the inner back iron to the cylinder, the compliant bellows positioned within the helical spring.

3. The linear compressor of claim 2, wherein the flex mount contacts and is coupled to the helical spring within the inner back iron.

4. The linear compressor of claim 1, wherein the flex mount defines a suction gas inlet, the flex mount, the compliant bellows and the piston defining a suction gas passage from the suction gas inlet of the flex mount to the piston within the cylinder.

5. The linear compressor of claim 4, wherein the muffler is disposed within the suction gas passage.

6. The linear compressor of claim 4, wherein the compliant bellows obstructs lubrication oil from flowing into the suction gas passage between the inner back iron and the piston.

7. The linear compressor of claim 1, wherein the compliant bellows is radially compliant.

8. The linear compressor of claim 1, wherein the compliant bellows extends about the coupling between the inner back iron and the piston, the compliant bellows comprising an elastomer tube with concertinaed sides.

9. A linear compressor, comprising:

a cylinder defining a chamber;

a piston slidably received within the chamber of the cylinder, a driving coil;

an inner back iron positioned in the driving coil, the inner back iron having an outer surface;

a magnet mounted to the inner back iron at the outer surface of the inner back iron, the driving coil operable to generate a magnetic field that engages the magnet to reciprocate the inner back iron within the driving coil;

a flex mount positioned within the inner back iron and coupled to the inner back iron;

a coupling connecting the flex mount to the piston such that the piston reciprocates with the inner back iron;

a compliant bellows extending about the coupling between the inner back iron and the piston, the compliant bellows comprises an elastomer tube with concertinaed sides; and a helical spring, the helical spring coupling the inner back iron to the cylinder, the compliant bellows positioned within the helical spring.

10. The linear compressor of claim 9, wherein the flex mount contacts and is coupled to the helical spring within the inner back iron.

11. The linear compressor of claim 9, wherein the flex mount defines a suction gas inlet, the flex mount, the compliant bellows and the piston defining a suction gas passage from the suction gas inlet of the flex mount to the piston within the cylinder.

12. The linear compressor of claim 11, further comprising a muffler disposed within the suction gas passage.

13. The linear compressor of claim 11, wherein the compliant bellows obstructs lubrication oil from flowing into the suction gas passage between the inner back iron and the piston.

14. The linear compressor of claim 9, further comprising a muffler mounted to the flex mount within the inner back iron.

15. The linear compressor of claim 14, wherein one end of the compliant bellows is mounted to the muffler within the inner back iron.

16. The linear compressor of claim 9, wherein the compliant bellows is radially compliant.

17. A linear compressor, comprising:

a cylinder defining a chamber;

a piston slidably received within the chamber of the cylinder;

a driving coil;

an inner back iron positioned in the driving coil, the inner back iron having an outer surface;

a magnet mounted to the inner back iron at the outer surface of the inner back iron, the driving coil operable to generate a magnetic field that engages the magnet to reciprocate the inner back iron within the driving coil;

a flex mount positioned within the inner back iron and coupled to the inner back iron;

a coupling connecting the flex mount to the piston such that the piston reciprocates with the inner back iron; and a compliant bellows extending about the coupling between the inner back iron and the piston, the compliant bellows comprises an elastomer tube with concertinaed sides, wherein the inner back iron is coupled to a planar spring.

18. The linear compressor of claim 17, wherein the flex mount defines a suction gas inlet, the flex mount, the compliant bellows and the piston defining a suction gas passage from the suction gas inlet of the flex mount to the piston within the cylinder.

19. The linear compressor of claim 18, further comprising a muffler disposed within the suction gas passage.

20. The linear compressor of claim 18, wherein the compliant bellows obstructs lubrication oil from flowing into the suction gas passage between the inner back iron and the piston.

* * * * *